United States Patent [19]

Fiedler

[11] 3,996,048

[45] Dec. 7, 1976

[54] METHOD OF PRODUCING HOLES IN POWDER METALLURGY PARTS

[75] Inventor: Louis J. Fiedler, Trumbull, Conn.

[73] Assignee: Avco Corporation, Stratford, Conn.

[22] Filed: Oct. 16, 1975

[21] Appl. No.: 623,154

[52] U.S. Cl. ..... 75/208 R; 75/200; 75/226

[51] Int. Cl.[2] ..... B22F 3/00

[58] Field of Search ..... 75/226, 200, 208 R

[56] References Cited

UNITED STATES PATENTS

| | | | |
|---|---|---|---|
| 3,622,313 | 11/1971 | Havel | 75/226 |
| 3,738,830 | 6/1973 | Kimura et al. | 75/226 |
| 3,773,506 | 11/1973 | Larker et al. | 75/226 |
| 3,804,575 | 4/1974 | Chandhok | 75/226 |
| 3,844,778 | 10/1974 | Malone et al. | 75/226 |

*Primary Examiner*—Brooks H. Hunt
*Attorney, Agent, or Firm*—Charles M. Hogan; Irwin P. Garfinkle; Lawrence I. Field

[57] ABSTRACT

A procedure for providing bores or other internal passages in hot isostatically pressed powder metal articles, especially those formed of nickel- or cobalt-base superalloys in which the passage is defined by a thin walled metal tube filled with refractory oxide ($MgO$ or $SiO_2$), which is embedded in the metal powder. After hot isostatic pressing the refractory oxide core is removed by leaching, leaving a smooth bore in the finished article.

6 Claims, No Drawings

METHOD OF PRODUCING HOLES IN POWDER METALLURGY PARTS

This invention relates to a powder metallurgy process for producing articles having holes or passages therein.

Numerous techniques have been developed over the years for producing such articles, many of which are described in the patent literature.

Thus, one proposal described in Lowit, U.S. Pat. No. 2,373,405 issued Apr. 10, 1945, involves the following sequence of steps: partially filling a mold with metal powder; centering a glass rod in the metal powder in the mold, entirely filling mold with metal powder around the glass rod, compacting the metal powder in the mold about glass rod; sintering the metal powder, melting out the glass core; inserting a metal core in place of the glass core and mechanically working the resulting composite article.

Another procedure described in Haller, U.S. Pat. Nos. 2,695,230 and 2,751,293 issued Nov. 23, 1954 and June 19, 1956 respectively, describes the use of a meltable core which infiltrates a powdered metal mass and leaves the desired void or voids behind.

A more recent U.S. Pat. No. 3,773,506 issued Nov. 21, 1973 to Larker et al., describes the manufacturing of turbine blades having one or more internal cooling channels. In this method, tubes corresponding to the desired configuration of cooling channels are pre-fabricated and a means is provided for pressurizing the tubes to prevent their collapse during the hot isostatic pressing to which the powder article is subjected. The tubes are placed in their desired location in the metal powder after which the composite is subjected to hot isostatic compression. Finally, the ends of the tubes are removed, opening the cooling channels.

Such methods as those described in the above noted patents and others known in the art are tedious and expensive, and are not suitable for alloys which may be either weakened by infiltration of a meltable core or which may be contaminated by direct contact between a ceramic core and the powdered alloy during consolidation.

The present invention is directed to a simplification of such prior art methods which is particularly suitable for the processing of nickel-base or cobalt-base superalloys of the analyses described in U.S. Pat. Nos. 3,639,179; 3,793,011 and 3,825,420 and in other recent patents.

The method of this invention is generally suitable for use in parts to be provided with internal passages when they are consolidated from metal powders.

The method involves pre-placing thin wall tubing of a composition compatible with that of the final part into the mold prior to filling with powder. After the mold is filled with powder and sealed, it is consolidated by hot isostatic pressing in the known manner. The tubing is filled with a leachable ceramic, e.g. MgO, CaO, or $SiO_2$ to prevent its collapse during the hot isostatic pressing step.

By the use of a compatible composition, e.g. Inconel-X used with nickel base superalloy powder, composition gradient and hence property degradation is minimal.

Interior surfaces of passages are smooth and sound following leaching of ceramic filler after consolidation. With the compositions described above the powder will consolidate to form a diffusion bond to the tube inserts during hot isostatic pressing.

The following is a more detailed description of procedures which constitute preferred embodiments of the invention.

Thin-walled, e.g. 0.01 to 0.05 inch thick, ceramic filled tubes are cut to length and, if necessary, shaped to a desired form. The proper spatial relationship of the tubes in the mold cavity and hence in the finished consolidated part, is maintained by special indentations in the mold wall specifically designed to retain the tube ends or, if preferred simple metallic fixtures are tack welded to the ends of the tubes and are located in such a way that they can be machined away after consolidation of the powder. The tubing fixture assembly is positioned in the mold cavity using means which maintain it in proper position (e.g. tack welding). Then the mold is filled with metal powder, canned, evacuated and sealed, prior to subsequent hot isostatic pressing.

If a powder mold is prepared by ceramic investment techniques using the lost wax process, pre-cut and formed tubes are located in the wax model with one or both ends of the tubes protruding from the wax model. When invested in the ceramic mold material, the tubes will be retained within the mold cavity in their proper spatial relationship. The ceramic mold is subsequently filled with powder, canned, evacuated and sealed in the usual way before hot isostatic consolidation.

After the mold has been properly filled with powder, and evacuated and sealed, it is subjected to hot isostatic pressing (HIP) to consolidate the powder to essentially 100 percent theoretical density and simultaneously produce a diffusion bond between thin wall tube and the consolidated parent metal powder. The parameters for the hot isostatic pressing are dependent on the particular alloy system being utilized but for nickel base alloys the following have been successfully utilized:

| | | |
|---|---|---|
| Temperature | — | about 2150° F (range 2000° F–2225° F) |
| Pressure | — | about 13,000 psi (range 10,000 to 30,000 psi) |
| Time | — | about 2 hours (range 1–4 hours) |

On completion of the hot isostatic pressing step, the mold material is stripped off of the consolidated powder part and machining operations performed, if necessary, to expose the ends of the tubes. The ceramic core material is dissolved out of the internal passages using dilute acid solutions for magnesia core materials and alkaline solutions at moderate temperatures and pressures for silica core materials.

This invention is suitable for use with nickel base superalloys, e.g. those containing about 6–20% chromium, 0.5–6% aluminum and/or titanium, 0–20% cobalt, with optional additions of molybdenum tungsten, niobium, and tantalum. For alloys of this type, a nickel base alloy tubing with a ceramic core is used. The composition of the tubing is typical of commercial nickel base alloys that are readily available in the form of tube, and contain nominally 14–20% chromium with optional additions of aluminum and/or titanium up to about 3.5%. Examples of such alloys are Inconel 600, Inconel 702, and Inconel X750, and other alloys commercially available in tube form.

This invention is also applicable to titanium-base alloy parts designed to have cavities in the finished part. Tube alloys suitable for titanium parts include commercially pure (CP) titanium or Ti-3Al-2.5V alloy, both being commercially available as tubing.

It will be understood that the holes are not necessarily round but could be any simple shape. This merely requires that the tube starting stock be drawn through an appropriate series of shaped dies rather than round dies, prior to insertion in the mold.

I claim:

1. A powder metallurgy process for producing fully consolidated articles which exhibit substantially 100% theoretical density and which are provided with bores or other internal passages, which process includes:

preparing a replica of the desired passages from thin walled metal tubing filled with a leachable refractory oxide, positioning said replica in a mold having a cavity defining the shape of the desired article, filling the mold cavity with metal powder to be consolidated around the replica to form an unconsolidated composite, hot isostatically pressing the composite whereby the powder and tube become bonded to one another, and leaching the refractory oxide from the tubes in the consolidated article.

2. The process of claim 1 wherein the tubing has a wall thickness of between 0.010 and 0.050 inches.

3. The process of claim 1 wherein the refractory oxide is selected from the group consisting of MgO, CaO, $SiO_2$ and mixtures thereof.

4. The process of claim 1 wherein the leaching is accomplished by means of an alkaline liquid.

5. The process of claim 1 wherein the leaching is accomplished by means of an acid.

6. The process of claim 1 wherein the powder is of a nickel- or cobalt-base superalloy and the tubing is of an alloy which diffusion bonds to said powder during the hot isostatic pressing.

* * * * *